US009840367B2

(12) United States Patent
Fitzgerald

(10) Patent No.: US 9,840,367 B2
(45) Date of Patent: Dec. 12, 2017

(54) MULTI-FUNCTION CLOSURE FOR A LIQUID CONTAINMENT TANK

(71) Applicant: Meridian Manufacturing, Inc., Storm Lake, IA (US)

(72) Inventor: Christopher T. Fitzgerald, Pomeroy, IA (US)

(73) Assignee: Meridian Manufacturing, Inc., Storm Lake, IA (US)

( * ) Notice: Subject to any disclaimer, the term of this patent is extended or adjusted under 35 U.S.C. 154(b) by 764 days.

(21) Appl. No.: 14/306,364

(22) Filed: Jun. 17, 2014

(65) Prior Publication Data

US 2015/0360859 A1 Dec. 17, 2015

(51) Int. Cl.

| | |
|---|---|
| ***B65D 90/10*** | (2006.01) |
| ***B65D 90/24*** | (2006.01) |
| ***B65D 90/34*** | (2006.01) |
| ***B65D 90/48*** | (2006.01) |
| ***B65D 90/54*** | (2006.01) |

(52) U.S. Cl.

CPC ..... *B65D 90/24* (2013.01); *B65D 90/10* (2013.01); *B65D 90/34* (2013.01); *B65D 90/48* (2013.01); *B65D 90/545* (2013.01)

(58) Field of Classification Search

CPC ..... B65D 90/24; B65D 90/10; B65D 90/34; B65D 90/48; B65D 90/545

USPC ..... 220/581, 212, 361; 138/89

See application file for complete search history.

(56) References Cited

U.S. PATENT DOCUMENTS

| | | | | |
|---|---|---|---|---|
| 4,162,020 | A | 7/1979 | Kirkland | |
| 4,278,115 | A * | 7/1981 | Briles | B65D 90/105 137/312 |
| 4,472,911 | A * | 9/1984 | Jooris | E03F 5/02 404/25 |
| 4,685,327 | A * | 8/1987 | Sharp | B65D 90/501 220/560.03 |
| 4,762,440 | A | 8/1988 | Argandona | |
| 4,842,443 | A | 6/1989 | Argandona | |
| 4,934,553 | A * | 6/1990 | McCarthy | B65D 90/041 220/565 |
| 5,071,166 | A | 12/1991 | Marino | |
| 5,222,832 | A * | 6/1993 | Sunderhaus | B65D 90/105 141/86 |
| 5,295,535 | A | 3/1994 | Boles et al. | |
| 5,718,460 | A | 2/1998 | Glunt et al. | |
| 5,832,673 | A | 11/1998 | Cho | |
| 5,833,391 | A | 11/1998 | Daigle | |
| 6,527,476 | B1 * | 3/2003 | Pettesch | B65D 90/105 404/26 |

(Continued)

*Primary Examiner* — King M Chu

(74) *Attorney, Agent, or Firm* — McKee, Voorhees & Sease PLC

(57) ABSTRACT

A multi-function closure is provided for a liquid containment tank. The tank has an upper wall with an inspection opening therein. The closure includes a ring attached to the upper wall and extending around the inspection opening. A pan is removably fastened to the ring, and has a bottom and side wall forming a reservoir for collection of spilled liquid. A lid is pivotally connected to the pan for movement between open and closed positions, and can be locked in the closed position. Multiple ports are formed in the bottom of the pan for filling the tank with liquid, and suctioning or pumping liquid from the tank for discharge.

19 Claims, 6 Drawing Sheets

(56) References Cited

U.S. PATENT DOCUMENTS

| | | | | |
|---|---|---|---|---|
| 6,840,293 | B1 * | 1/2005 | Smith | B65D 90/10 137/312 |
| 7,347,644 | B2 | 3/2008 | Meyers | |
| 7,574,831 | B2 | 8/2009 | Meyers | |
| 7,770,333 | B2 | 8/2010 | Meyers | |
| 7,997,031 | B2 | 8/2011 | Meyers | |
| 8,033,581 | B2 | 10/2011 | Crouse | |
| D678,478 | S | 3/2013 | Thielbar | |
| D678,479 | S | 3/2013 | Thielbar | |
| 8,622,097 | B2 | 1/2014 | Kane et al. | |
| 2009/0006026 | A1 | 1/2009 | Clover | |
| 2012/0091141 | A1 | 4/2012 | Thielbar | |
| 2012/0256410 | A1 | 10/2012 | Russell | |

* cited by examiner

MULTI-FUNCTION CLOSURE FOR A LIQUID CONTAINMENT TANK

BACKGROUND OF THE INVENTION

Mobile and stationary bulk liquid containers or tanks come in many different sizes and shapes, and are used both above ground and below ground. These tanks typically require openings or porting to allow liquid to be introduced and removed from the tank, for venting of the tank, and for inspection of the tank interior. In some applications, government regulations require capture and containment of any spillage to avoid environmental issues. Also, contamination ingress is a concern in some applications. The various tank openings are separate and independent from one another. Each opening requires a lid or cap which can be removed as needed. The largest opening is a manway to accommodate scheduled, mandatory inspections and recertification of the tank. The fill ports are usually located in the top of a tank. A discharge port may also be located in the top of the tank for removal of fluid by suction or pumping. A vent port is also located in the top of the tank to displace air when liquid is added to the tank. Each port in these prior art tanks requires a seal to preclude leakage into or from the tank, with each seal providing an opportunity for leakage failure.

Therefore, a primary objective of the present invention is the provision of an improved closure for bulk liquid containment tanks.

Another objective of the present invention is the provision a closure for a liquid containment tank manway opening with multiple ports formed in the closure to accommodate liquid filling and discharge from the tank.

Yet another objective of the present invention is the provision a multi-functional closure for a liquid containment tank which minimizes the risk of liquid leakage into or out of the tank.

Still another objective of the present invention is the provision of a closure for a liquid containment tank manway opening having an anti-spill reservoir to capture spilled liquids being introduced to or removed from the tank.

Another objective of the present invention is the provision of a closure for a liquid containment tank which incorporates all the necessary ports required by the tank.

Yet another objective of the present invention is the provision of a closure for a liquid containment tank opening which can be used on a flat-walled or curved-walled tank.

A further objective of the present invention is the provision of a tank closure which can be used on mobile and stationary liquid containment tanks.

Another objective of the present invention is a closure for use on flat and curved wall liquid containment tanks.

Still another objective of the present invention is the provision of a closure for a liquid containment tank opening which protects and secures multiple openings in the closure and into the tank.

A further objective of the present invention is the provision of a closure for a bulk liquid containment tank inspection opening which is easy and economical to manufacture, and safe and durable in use in filling, emptying, and inspecting the tank.

These and other objectives will become apparent from the following description of the invention.

SUMMARY OF THE INVENTION

A multi-function closure is provided for a bulk liquid containment tank having an inspection opening in the top wall or top portion of the tank. The closure is mounted to the tank over the inspection opening. The closure includes a ring attached to the top or upper wall of the tank and extending around the inspection opening. The closure also includes a pan removably fastened to the ring and a lid pivotally connected to the pan for movement between open and closed positions. Multiple ports are formed in the bottom of the pan for the tank liquid functions, including filling the tank and removing liquid from the tank. The pan has a reservoir for capturing and collecting any liquid spills, and a drain to dispose of collected liquid. The pan and lid can be removed from the ring to provide access to the inspection opening for periodic inspections of the tank interior.

DETAILED DESCRIPTION OF THE PREFERRED EMBODIMENTS

Figure 1:
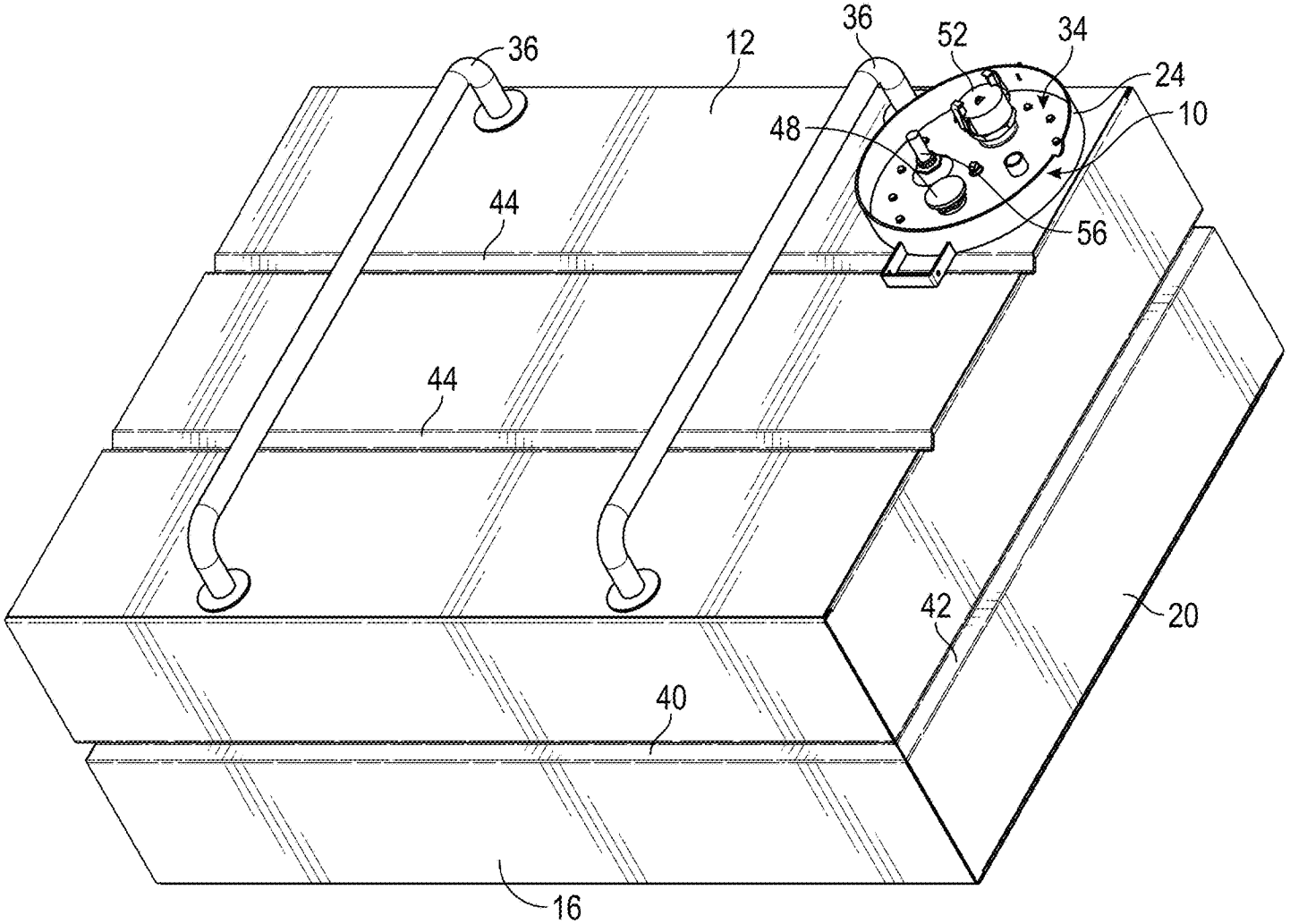
FIG. 1 is a perspective view of a liquid containment tank having the closure of the present invention, with the lid removed to show the multi-function features of the closure.

The tank closure of the present invention is generally designated in the drawings by the reference numeral 10. The closure 10 can be used on various size and shaped tanks, including a flat-walled and flat-top tank 12, as shown in the drawings, or on curved wall or cylindrical tanks. The closure 10 is typically installed on the top of the tank, pursuant to governmental rules and regulations.

The closure 10 has three primary components, a ring 14, a pan 16, and a lid 18. The ring 14 is welded or otherwise fixed to the top wall of the tank so as to extend around an inspection opening in the tank 12 used for periodic inspections of the tank interior. The ring 14 has an annular vertical lip 20 extending into the inspection opening of the tank 12, and an annular horizontal flange 22 residing on top of the tank 12. A gasket may be provided between the horizontal flange 22 and the upper tank wall. The ring 14 provides the transition between the tank and the pan 16, whether the tank is flat-walled or curved wall.

The pan 16 is removably attached to the flange 22 of the ring 14 in any convenient manner, such as by a plurality of nuts and bolts 26. The pan 16 includes a bottom wall 28 and a side wall 30 which form a cavity or reservoir 32 for capturing liquids spilled during filling or discharge of the tank 12.

Figure 2:
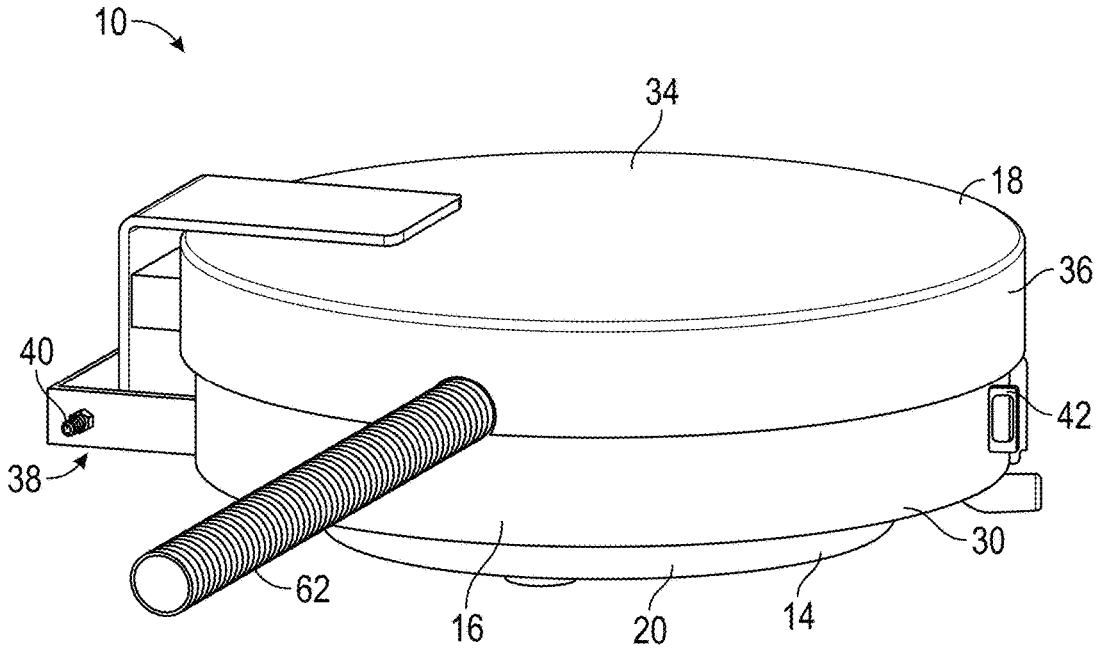
FIG. 2 is a perspective view of the closure with the lid in a closed position.
Figure 3:
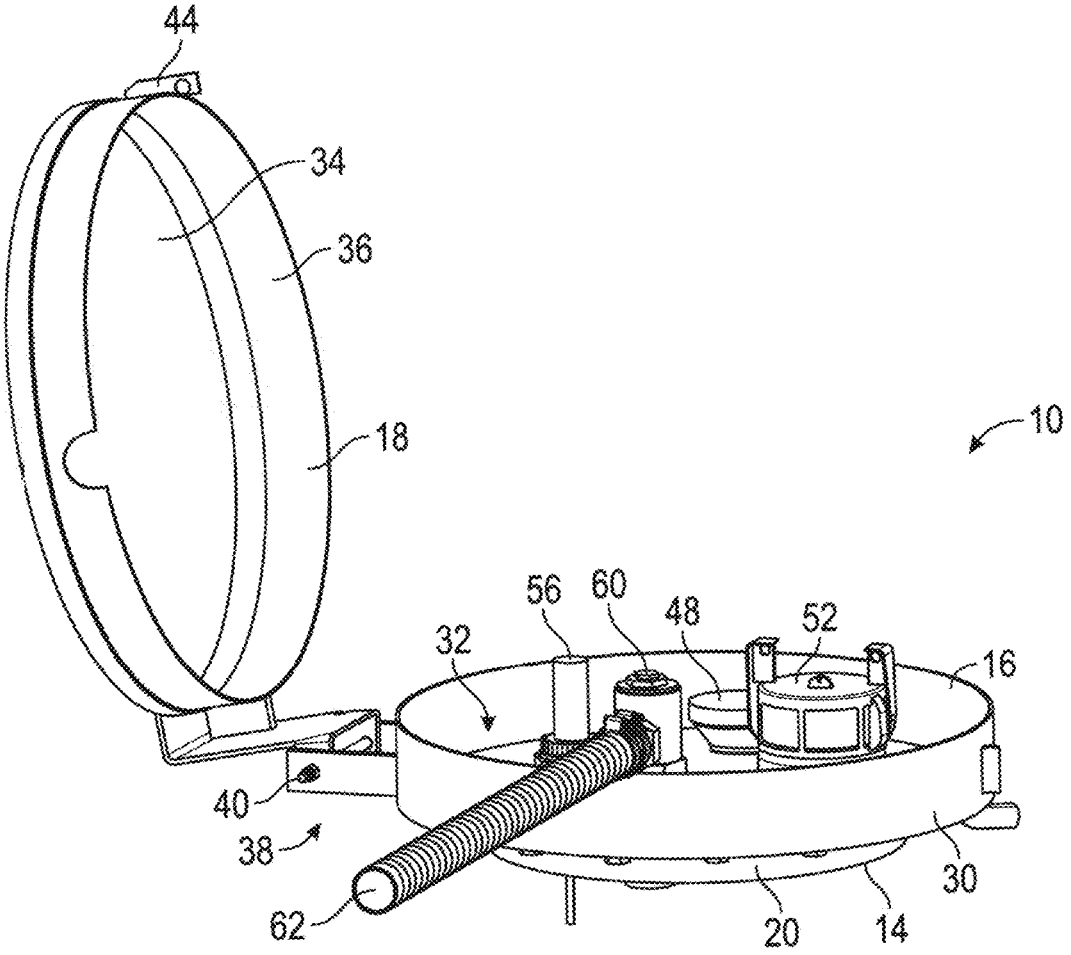
FIG. 3 is a perspective view of the closure with the lid in an open position.
Figure 4:
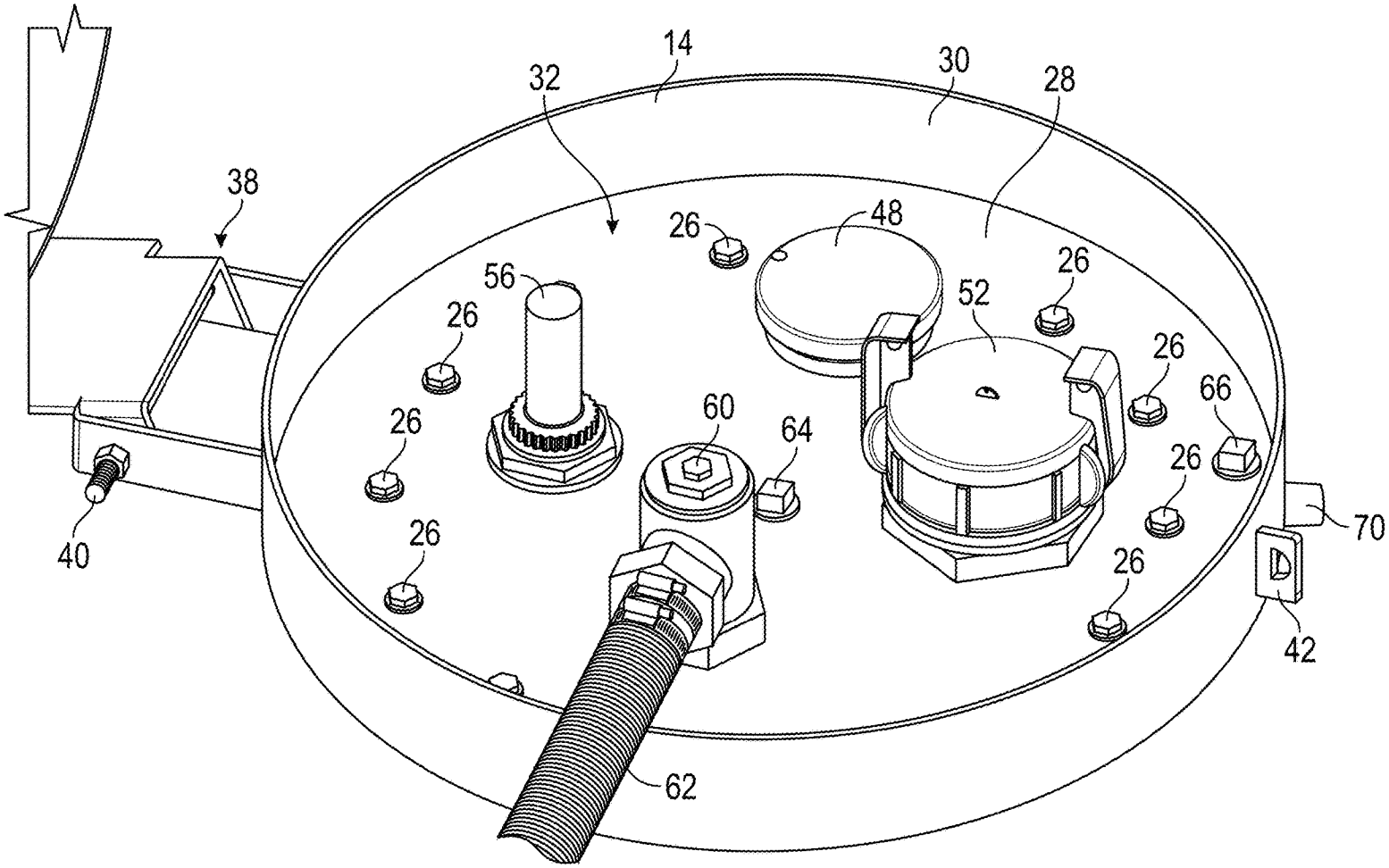
FIG. 4 is an enlarged view of the pan with multiple ports.
Figure 5:
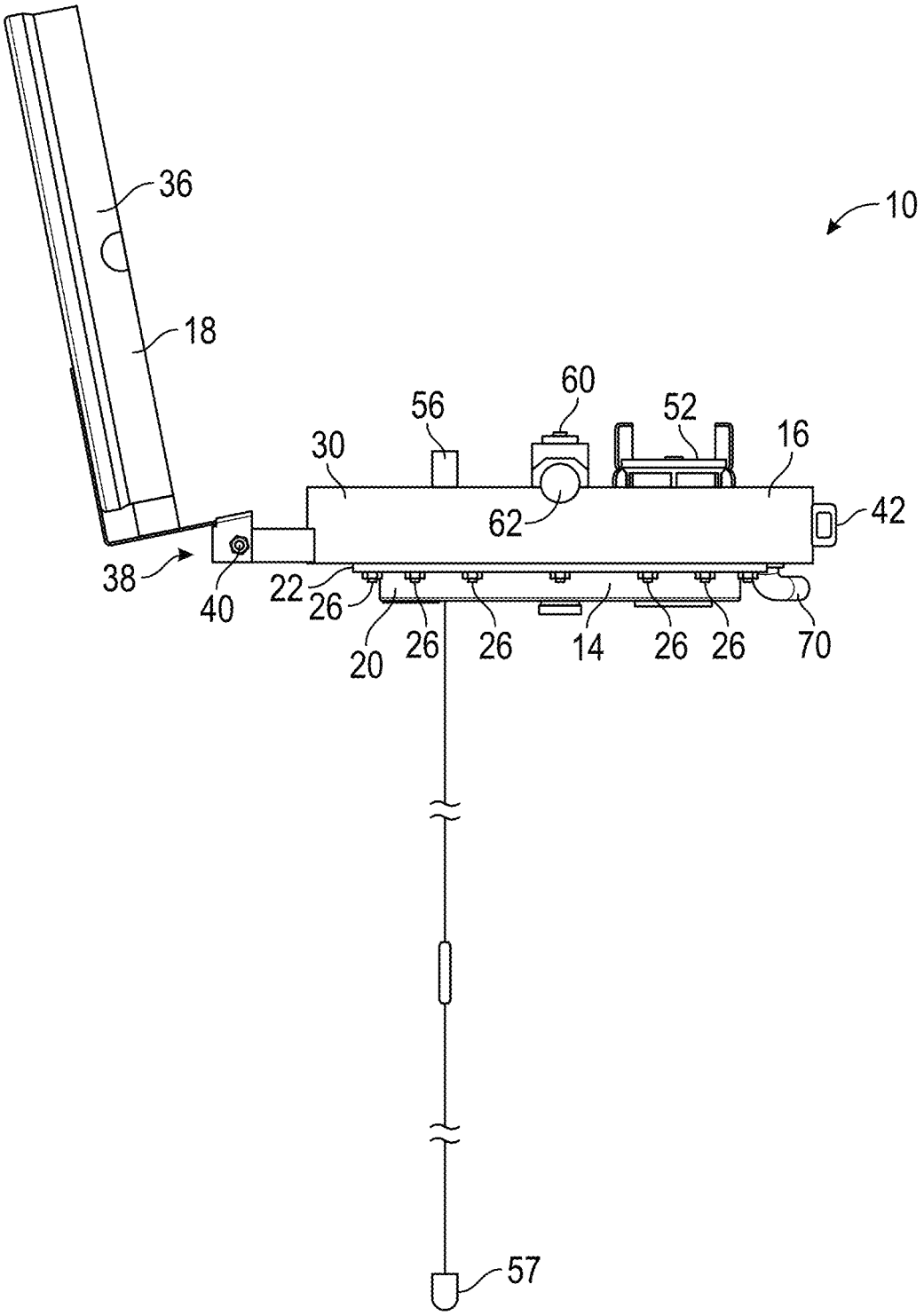
FIG. 5 is a side elevation view of the closure, with the lid in an open position.
Figure 6:
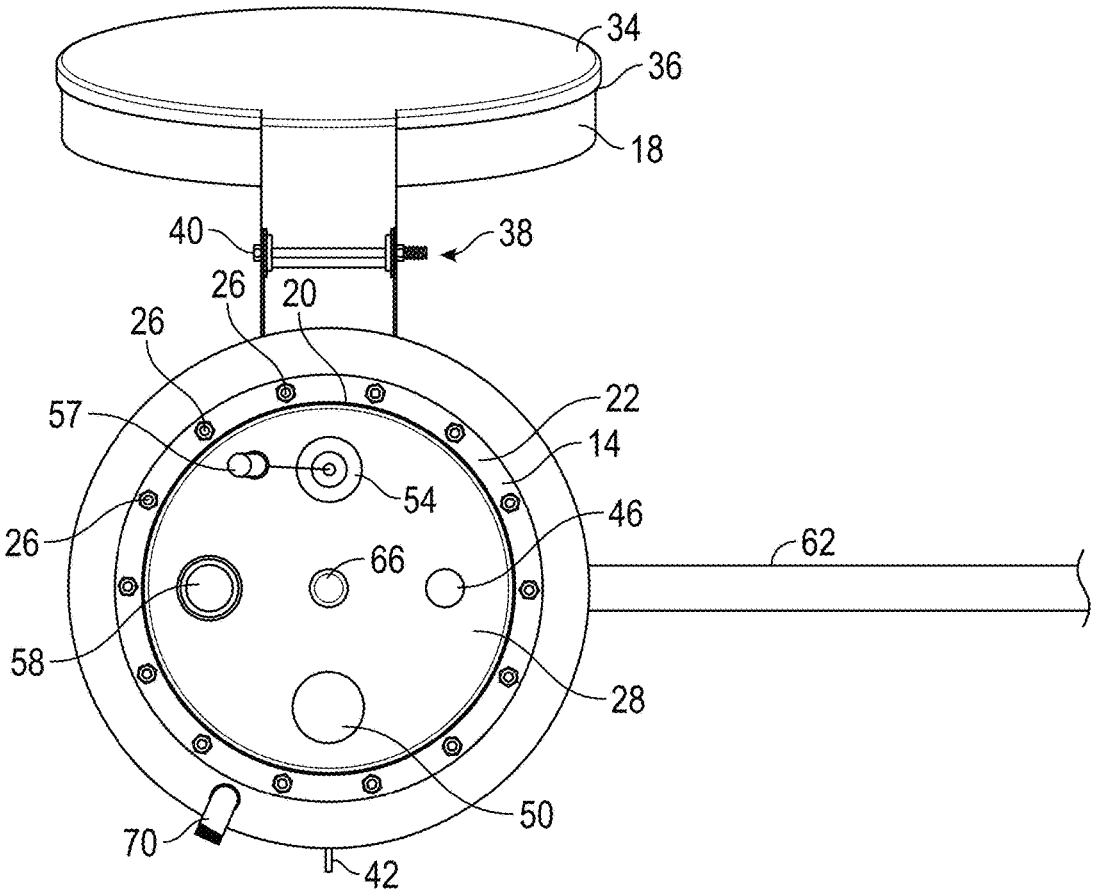
FIG. 6 is a bottom plan view of the closure, with the lid in the open position.

The lid 18 is pivotally connected to the pan 16 for movement between a closed position, shown in FIG. 2, and an open position, shown in FIG. 3. The lid includes a top wall 34 and a side wall 36. The diameter of the side wall 36 is slightly larger than the diameter of the pan side wall 30, so that the lid 18 overlays the pan 16 when in the closed position. The pivotal connection between the pan 16 and lid 18 can be formed in any known and convenient manner, such as a hinge 38 with a substantially horizontal pivot axis 40. The pan 16 and lid 18 each include a tab 42, 44, respectively, which overlay each other when the lid 18 is closed. The tabs 42, 44 each have a hole for receipt of a padlock (not shown), so that the lid 18 can be locked in the closed position to prevent unauthorized access to the interior of the closure 10.

The pan 16 has a plurality of ports formed in the bottom wall 28. The ports provide multi-functionality for the closure 10. For example, a first inlet port 46 is provided for introducing liquid into the tank 12. A removable cap 48 is provided for the port 46, and can be threaded or otherwise connected in any known manner. Preferably, the cap 48 is vented. A second inlet port 50 may be provided in the pan 16 to allow filling of the tank 12 from two separate liquid sources, to speed up the filling process. The port 50 may be provided with a cam lock coupling 52 which accepts a mating nozzle on the end of a fill hose. The cam lock coupling 52 provides a sealed connection so as to preclude spillage during filling of the tank 12.

A third port 54 may be provided in the bottom 28 of the pan 16, with a depth gauge 56 mounted therein. The depth gauge 56 includes a float 57 extending downwardly into the tank 12. The depth gauge 56 allows the level of liquid in the tank 12 to be monitored. A fourth port 58 in the pan 16 forms a liquid discharge outlet. For example, the tank 12 may include an internal pump (not shown) connected to a anti-syphon valve 60 mounted to the port 58, with a hose 62 leading from the valve 60 to discharge liquid from the tank 12.

The pan 16 may also include a pair of plugs 64, 66. The plug 64 is removably threaded into a reclamation port 68 which allows any "clean" liquid spilled into the reservoir 32 to be directed back into the tank 12. The plug 66 is removably threaded into a $6^{th}$ port in the pan 16 to drain any "dirty" spillage from the reservoir 32 into a bucket or can via a drain line 70 for disposal.

With the closure 10 of the present invention, the tank 12 only has one opening, the inspection opening, formed therein, with the remaining functional ports 46, 50, 54 and 58 being formed in the pan 16. Thus, only one seal is required for the tank 12. Appropriate seals may be provided on the inside of the pan 16 for the ports 46, 50, 54, and 58 and the cap 48, cam lock coupling 52, depth gauge 56, and syphon valve 60.

The closure 10 meets all the general Canadian design requirements for a registered, UN Standard Mobile IBC, including the fill port(s) being located in the top of a tank, a discharge port in the top of the tank, venting in the top of the tank, and a manway for the scheduled, mandatory inspections and recertification of the tank. The lid 18 protects the various ports, and secures unauthorized access when the lid 18 is locked to the pan 16.

Accordingly, the closure 10 achieves at least all of the stated objectives of the present invention.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A multi-function closure for a liquid containment tank having an upper wall with an inspection opening therein, comprising:

a ring attached to the upper wall and extending around the inspection opening;

a pan removably fastened to the ring and having a bottom and side wall;

a lid pivotally connected to the pan for movement between open and closed positions; and multiple ports formed in the bottom of the pan for tank liquid functions.

2. The closure of claim 1 wherein the ports include a fill opening and a discharge opening.

3. The closure of claim 1 wherein the ports include a depth gauge opening.

4. The closure of claim 1 wherein the pan defines a reservoir for collection of spilled liquid.

5. The closure of claim 4 further comprising a drain opening in the pan for drainage of spilled liquid.

6. The closure of claim 1 further comprising a siphon valve on the pan and connected to one of the ports.

7. The closure of claim 1 further comprising a gasket engaging the tank.

8. The closure of claim 1 further comprising overlapping lock tabs on the pan and on the lid to receive a padlock.

9. The closure of claim 1 further comprising a depth gauge mounted on the pan and connected to a float residing in the tank to measure the depth of liquid in the tank.

10. A bulk liquid containment tank, comprising:

a top portion with an opening therein;

a closure mounted to the tank over the opening;

a plurality of ports in the closure, the ports normally being closed;

the closure including a pan with the ports formed therein and forming a reservoir for collecting spilled liquid; and the pan including a drain for draining spilled liquid from the reservoir.

11. A bulk liquid containment tank, comprising:

a top portion with an opening therein;

a closure mounted to the tank over the opening;

a plurality of ports in the closure, the ports normally being closed;

the closure including a pan with the ports formed therein and forming a reservoir for collecting spilled liquid; and the closure further including a lid pivotally mounted to the pan for movement between open and closed positions.

12. The storage tank of claim 11 further comprising overlapping tabs on the pan and the lid adapted to receive a lock.

13. A bulk liquid containment tank, comprising:

a top portion with an opening therein;

a closure mounted to the tank over the opening;

a plurality of ports in the closure, the ports normally being closed;

the ports including a first opening for adding liquid to the tank, a second opening for removing liquid from the tank, and a third opening with a depth gauge mounted therein.

14. The storage tank of claim 13 wherein the ports include a fourth opening for adding liquid fill or removal.

15. A bulk liquid containment tank, comprising:

a top portion with an opening therein;

a closure mounted to the tank over the opening;

a plurality of ports in the closure, the ports normally being closed; and a gasket between the closure and the top portion of the tank.

16. A bulk liquid containment tank, comprising:

a top portion with an opening therein;

a closure mounted to the tank over the opening;

a plurality of ports in the closure, the ports normally being closed;

the closure including a ring fixed to the top portion and extending around the tank opening; and the closure including a pan removably mounted to the ring and a lid pivotally connected to the pan, and the ports being formed in the pan.

17. The storage tank of claim 10 wherein the closure further includes a lid pivotally mounted to the pan for movement between open and closed positions.

18. The storage tank of claim 11 wherein the ports include a first opening for adding liquid to the tank, a second opening for removing liquid from the tank, and a third opening with a depth gauge mounted therein.

19. The storage tank of claim 16 wherein the pan has a reservoir for collecting spilled liquid.

* * * * *